United States Patent [19]

Herrington

[11] Patent Number: 4,732,065

[45] Date of Patent: Mar. 22, 1988

[54] ROTARY SERRATED TUBE PUNCH WITH INTERNAL BACK-UP FOR A FILM WEB AND METHOD OF PUNCHING HOLES THEREWITH

[75] Inventor: Fox J. Herrington, Holcomb, N.Y.

[73] Assignee: Mobil Oil Corporation, New York, N.Y.

[21] Appl. No.: 905,090

[22] Filed: Sep. 8, 1986

[51] Int. Cl.[4] ..... B26F 1/08

[52] U.S. Cl. ..... 83/18; 83/24; 83/37; 83/100; 83/175; 83/345; 83/670

[58] Field of Search ..... 83/18, 24, 37, 100, 83/175, 345, 670

[56] References Cited

U.S. PATENT DOCUMENTS

| | | | |
|---|---|---|---|
| 1,814,867 | 7/1931 | Swift, Jr. . | |
| 2,230,778 | 2/1941 | Flores . | |
| 2,264,134 | 11/1941 | Hawley | 83/345 |
| 2,522,154 | 9/1950 | Asmussen . | |
| 2,561,050 | 7/1951 | Charron et al. . | |
| 2,749,981 | 6/1956 | MacKinnon et al. . | |
| 2,966,085 | 12/1960 | Hanson . | |
| 3,147,656 | 9/1964 | Kwitek . | |
| 3,236,130 | 2/1966 | Robert . | |
| 3,277,756 | 10/1966 | Des Jardins et al. . | |
| 3,483,780 | 12/1969 | Hudson . | |
| 3,550,491 | 12/1970 | Wingard . | |
| 3,550,494 | 12/1970 | Adams et al. . | |
| 3,680,419 | 8/1972 | Stoop . | |
| 3,728,918 | 4/1973 | Helm . | |
| 4,080,856 | 3/1978 | Shearon . | |
| 4,224,851 | 9/1980 | Imai . | |
| 4,377,097 | 3/1983 | Calvano . | |
| 4,452,114 | 6/1984 | Rynik et al. . | |
| 4,480,516 | 11/1984 | Leroy . | |
| 4,594,926 | 6/1986 | Propheter | 83/345 |
| 4,693,152 | 9/1987 | Grosz et al. | 83/345 X |

*Primary Examiner*—Frank T. Yost
*Attorney, Agent, or Firm*—Alexander J. McKillop; Michael G. Gilman; Charles J. Speciale

[57] ABSTRACT

A method of accurately punching holes into a moving web of a thermoplastic film material, and more particularly, punching holes into the web through the intermediary of a rotary serrated tube punch. The invention relates to accurately punching holes into an advancing web of thermoplastic film material utilizing a novel rotary serrated tube punch. The film web is continuously advanced over at least a portion of the circumferential surface of a rotatable anvil roll, and tensioned against the anvil roll surface through the use of suitable tensioning devices, such as tension rollers arranged upstream and downstream of the anvil roll. At least one opening is formed in the circumferential surface of the anvil roll which is smaller than the size of the hole which is desired to be punched into the film web through the use of the inventive rotary tube punching arrangement. An annular groove extends about the hole in the surface of the anvil roll, forming a land between the hole and the groove. The rotary tube punch possesses a serrated cutting edge at its radially outermost end, and is adapted to be rotated in synchronism with the anvil roll so as to cause the serrated cutting edge pierce through the web in a precisely aligned position with the groove in the rotating anvil roll, with the film web being supported on the land about the hole and on the anvil roll surface externally of the punch, and to thereby produce an accurately dimensioned hole in the moving web without the necessity for stopping the web. The anvil roll may be constructed hollow, and communicates with a suctioning source for aspirating punched out film material segments.

26 Claims, 10 Drawing Figures

ROTARY SERRATED TUBE PUNCH WITH INTERNAL BACK-UP FOR A FILM WEB AND METHOD OF PUNCHING HOLES THEREWITH

BACKGROUND OF THE INVENTION

1. Field of the Invention

The present invention relates to a method of accurately punching holes into a moving web of a thermoplastic film material, and more particularly, punching holes into the web through the intermediary of a rotary serrated tube punch, and with an internal back-up supporting the web of film material for enhancing support thereof during the punching of the holes therein. Moreover, the invention also relates to accurately punching holes into an advancing web of thermoplastic film material utilizing a novel rotary serrated tube punch, with an internal back-up supporting the film material during the hole punching procedure.

The invention also relates to a method and arrangement for accurately punching holes into a continuously advancing web of thermoplastic film material utilizing a novel rotary serrated tumbling tube punch, and with an internal back-up for the film web material within the cutting edge of the punch, in which the cutting edge of the punch pierces the film web at a substantially right angle to the film surface to attain an enhanced degree of punching precision and accuracy.

In the production of various types of articles which are basically formed from a thermoplastic film material, such as polyethylene film or the like; for instance, articles such as plastic bags employed in supermarkets or plastic garbage disposal or trash bags, it is frequently necessary to provide holes in a web of the thermoplastic film material employed for the high-speed series production of the bags, which must be punched through at a high degree of accuracy with respect to the location of the holes in the film web and repetitions in successive hole patterns. Thus, for instance, with regard to plastic bags onto which tapes are to be applied and which are used for closing trash bags in the manner of a drawstring, and into which there must be provided holes in order to afford a consumer access to the tape for closing the bags, the inability of presently employed production equipment in providing accurately positioned and dimensioned holes necessitates wider border edges to be formed on the film web for the receipt of such tapes, with the result of requiring greater amounts of plastic material in the formation of the bags thereby rendering current manufacturing methods less than optionally economical.

Thus, a need has arisen in industry for methods and apparatus for accurately punching holes of various sizes and configurations through webs of thermoplastic film material, in which the webs are conveyed in a continuous mode between processing stations so as to afford optimized production rates and extremely high degrees of manufacturing accuracy, without the need to stop the continual advance of the film web during the hole punching procedure.

Heretofore, one particular method of punching holes through polyethylene film webs contemplated the use of hole punching apparatus incorporating a tube forming a die punch having a cutting edge consisting of serrations or sharpened teeth facing towards the film. For example, a punching apparatus of that type is disclosed in Adams, et al. U.S. Pat. No. 3,580,120. The serrated cutting edge of the punch is then pressed through the film web while the latter is in a stationary condition during the intermittent advance of the web and with the web being supported externally of the die punch in order to maintain the necessary tension on the film web. Thus, in order to employ a serrated punch for punching holes into a film web, it is necessary to either advance the web only intermittently in order to prevent it from moving while the hole is being punched, or to reciprocate the punch so as to match the web speed when the latter is continually advanced, or to press the punch through the moving web and, as a result, produce a relatively ragged and inaccurate hole. Consequently, the prior art hole punching methods and apparatus are either complex in construction and/or cumbersome in use, and fail to provide the required accuracy in forming punched holes in a continuously advancing web of thermoplastic film material, so as to render them commercially viable or competitive.

2. Discussion of the Prior Art

Although numerous rotary film web or sheet material punching devices are currently known and widely employed in the technology, none of these devices are analogous to the arrangement pursuant to the present invention and in implementing the hole punching method as disclosed herein.

Stoop U.S. Pat. No. 3,680,419 discloses a rotary punch device in which a hollow rotating punch has a projecting cutting edge which is adapted to cut holes into a paper web advanced over an anvil roll, and wherein the chips which are punched out of the paper web aspirated through the punch by a vacuum. This prior art device, however, fails to provide for tensioning a thermoplastic film web about the circumference of an anvil roll and the punching of holes therethrough by a serrated cutting edge on a punch analogous to that of the present invention, and thus would not be capable of providing the desired degree of accuracy in the punching of holes into a continuously advancing web of a thermoplastic film material.

Leroy U.S. Pat. No. 4,480,516 discloses a rotatable cutting device contacting an anvil or counter roll over which a film web is advanced by means of a cutter possessing a cutting edge for severing the web into predetermined sections. This does not allow for the formation of holes in an accurate manner analogous to that afforded by the device and method pursuant to the present device.

Helm U.S. Pat. No. 3,728,918 discloses a rotary panel cutter through the intermediary of which sections are cut out of a continuously advanced film web. However, there is no disclosure of a serrated cutter engaging into an opening in an anvil roll to punch accurately-sized holes into a film web analogous to that of the present invention.

Other prior art methods and apparatus direct themselves to trimming strips from a continuously moving film web, such as Rynik U.S. Pat. No. 4,452,114; or to a cam-actuated serrated tube punching device for punching a plurality of holes into a film web, as disclosed in Adams, et al. U.S. Pat. No. 3,550,494. Neither of these publications, nor the other above-described U.S. Patents disclose a method and apparatus which enables the accurate punching of holes into a continuously advancing plastic film web.

SUMMARY OF THE INVENTION

Apparatus and methods for the punching of accurately positioned holes into a continuously advancing plastic film web has already been successfully developed, and is the subject matter of copending Herrington U.S. patent application Ser. No. 798,518, filed Nov. 15, 1985, and Herrington, et al. U.S. patent application Ser. No. 871,334, filed June 6, 1986, the disclosures of which are incorporated herein by reference, and which are commonly assigned to the assignee of this application. In the disclosure of U.S. Ser. No. 798,518 the cutting end of the serrated tub punch is fixedly attached at the radially outermost end of a rotatable arm, or fastened on the circumference of a rotatable disc member, and thereby initially pierces through the film web, which is supported on the surface of a cooperating anvil roll, with the leading edge of the cutting member and then towards the trailing edge thereof in a somewhat curvilinear or "rocking" motion. This curving piercing movement of the cutting teeth of the serrated tube cutter through the surface of the film web may produce an ovality of distortion in the hole being punched into the film web and to some extent, may not impart the desired hole size and/or configuration to the web commensurate with the size and slope of the tubular punch.

In order to still further improve upon the accuracy in the size of the holes being punched into a continuously advancing web of a plastic material, the disclosure of U.S. Ser. No. 871,334 provides for the incorporation of operative structures into the arrangement for rotating and supporting the rotary tubular punch enabling it to punch through the film web at substantially right angles to a tangential line relative to the film surface of the web being conducted over the anvil roll, and perpendicular to the opening formed in the anvil roll for receiving the punch.

The punching devices and methods described in the above-mentioned copending patent applications have, to a quit significant extent, alleviated the problems encountered in the technology in punching accurately-sized and configured holes through a continuously advancing thermoplastic film web. However, inasmuch as the hole in the backup anvil roll or plate supporting the film is somewhat larger than the outer diameter or peripheral dimensions of the tubular cutter, the support of the film about th cutting edge is, at times, inadequate so as to adversely affect the accuracy in the size of the hole being punched therethrough. Particularly in the punching out of larger-diameter holes through through the film, for example, such as 2-inch diameter holes, the punch evidences a tendency to drag the film into the hole of the anvil punch. This undesirable phenomenon is prevented by the inventive internal backup structure of the anvil roll or film support plate.

In essence, in order to improve upon the foregoing, the present invention provides for a rotary serrated tube punching arrangement in which a film web of a thermoplastic material is continuously advanced over at least a portion of the circumferential surface of a rotatable anvil roll which, if desired, may be hollow, and tensioned against the anvil roll surface through the use of suitable tensioning devices, such as tension rollers arranged upstream and downstream of the anvil roll. At least one opening is formed in the circumferential surface of the anvil roll which is slightly smaller in size than the size of the hole which is desired to be punched into the film web through the use of the inventive rotary tube punching arrangement, and with an annular groove or recessed channel being formed in the anvil roll surface for receiving the cutting edge of the punch, so as to provide a supportive land for the film web material within the confines of the punch cutting edge, surrounding the hole. A rotatable rotary tube punch possessing a serrated cutting edge at its radially outermost end, is adapted to be rotated in synchronism with the anvil roll so as to cause the serrated cutting edge pierce through the web in a precisely aligned position with and entering the annular groove in the rotating anvil roll about the land, and to thereby produce an accurately dimensioned hole in the moving web without the necessity for stopping the web. A vacuum may be applied to the interior of the anvil roll so as to aspirate and withdraw the chip of the film material punched out by the rotating punch.

Furthermore, the speeds of rotation and diameters of the anvil roll and of the rotating punch may be correlated with respect to each other, wherein the circumference of the anvil roll about which the film web is transported is essentially equal to the repeat length of the hole locations which are to be punched through the film web, or equal to an integral fraction or multiple thereof. The serrated cutting edge of the punch, the latter of which may be mounted on a rotatable disc or on the end of an arm journaled on a rotating shaft, rotates at a speed such that the cutting edge of the punch travels at the same linear speed of advance as the speed of the hole in the circumference of the anvil roll. The hole in the anvil roll is slightly smaller than the size of the serrated cutting edge of the punch, with the surface of the anvil roll surrounding the hole supporting the film web having a groove cut therein for receiving the cutting edge of the punch, thereby providing an annular land or support for the film radially inwardly of the cutting edge of the punch and thereby facilitating the accurate punching through of the film web by the cutting edge of the punch as the latter enters the annular groove about the hole in the anvil roll.

Pursuant to another aspect of the present invention, the serrated cutting edge on the punch and the complementary groove in the anvil roll need not be necessarily round in shape, but may be configured to allow for the punching of holes through the film web which are of various shapes; such as, for example, elliptical, oval or even polygonally-shaped holes each possessing accurate dimensions.

Accordingly, it is an object of the present invention to provide a unique rotary punching arrangement incorporating a rotary serrated tube punch engaging into a cutting edge-receiving groove extending about a slightly smaller opening provided in a rotatable anvil roll, so as to form a supportive backup or land about the hole, over the circumference of which there is tensioned a continuously advancing web of thermoplastic film material in order to punch accurately-sized holes into the web without distortion of the punched holes or dropping of the web material.

A more specific object resides in the provision of a rotary serrated tube punch which is rotated in synchronism with an anvil roll possessing an internal backup for the film web over which the film web is tensioned for forming accurately-sized and spaced holes in the film web.

Pursuant to another aspect of the invention, aspirating means is in communication with the interior of the anvil roll, the latter of which is of a hollow rotatable drum construction, for suctioning out the segments or chips of the thermoplastic film web punched out by the serrated punch, and for conveying the segments to waste receiving or disposal means.

In accordance with still another object of the present invention, there is provided a novel method for accurately punching holes into a continuously advancing thermoplastic film web utilizing the unique rotary serrated tube punch and anvil roll arrangements with internal film backup as described herein.

BRIEF DESCRIPTION OF THE DRAWINGS

Reference may now be had to the following detailed description of exemplary embodiments of the rotary tube punching arrangement, taken in conjunction with the accompanying drawings; in which.

DETAILED DESCRIPTION

Figure 1:
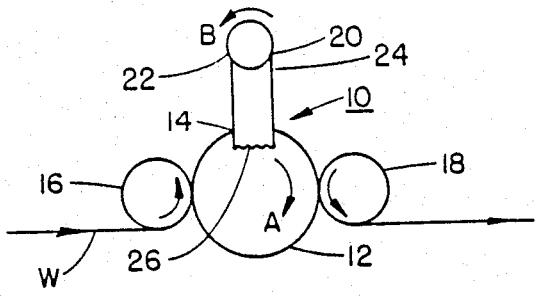
FIG. 1 PRIOR ART
FIG. 1 illustrates a schematic representation of a typical apparatus for punching holes in a continuously advancing film of a thermoplastic film web material.

Referring to FIG. 1 of the drawings, there is schematically illustrated a rotary die punching arrangement 10 for punching holes into a continuously advancing web W of a thermoplastic film material, for example, such as polyethylene film which is utilized in the production of plastic bags, trash disposal bags or the like. The die punching arrangement 10 basically incorporates an anvil roll 12, which in this embodiment is preferably but not necessarily of a hollow drum-like construction, and which has a punch-receiving internal backup encompassing an opening 14 formed in its circumferential surface, and with the cutting edge of a punch being adapted to engage in a complementary groove of the internal backup, as described hereinbelow. A pair of freely-rotatable tension rollers 16 and 18 are positioned respectively one each upstream and downstream of the anvil roll 12, preferably in surface contact therewith, along which there is conducted the film web W such that the rollers 16, 18 form tensioning guides for the web W as the web is being conducted over the circumferential surface of the anvil roll 12, to maintain the film thereon in a predetermined tensioned condition. The anvil roll 12 is rotated through a suitable drive in the direction of arrow A, while concurrently therewith a die punch arrangement 20 is rotated in the counter-rotatable direction of arrow B in predetermined synchronism therewith. The die punch arrangement 20 includes a rotatable shaft member 22 which may be driven in synchronism therewith with the anvil roll 12 by being either geared or belted therewith, as detailed in connection with FIGS. 2 to 6, and incorporates a radially extending tubular die punch 24 which, at its free end, has a serrated cutting edge 26 adapted to project into the groove or annular channel extending about punch-receiving opening 14 in the circumference of the anvil roll so as to cause the die punch 24 to punch a hole into the film web W.

The tensioning of the film web W by the tensioning rollers 16, 18 and the inventive internal backup about hole 14 in the anvil roll 12 will ensure that the hole which is punched therein by the rotatable punch 24 is accurately dimensioned and not distorted by any shifting of the film web on the anvil roll surface as it is being punched.

Figure 2:
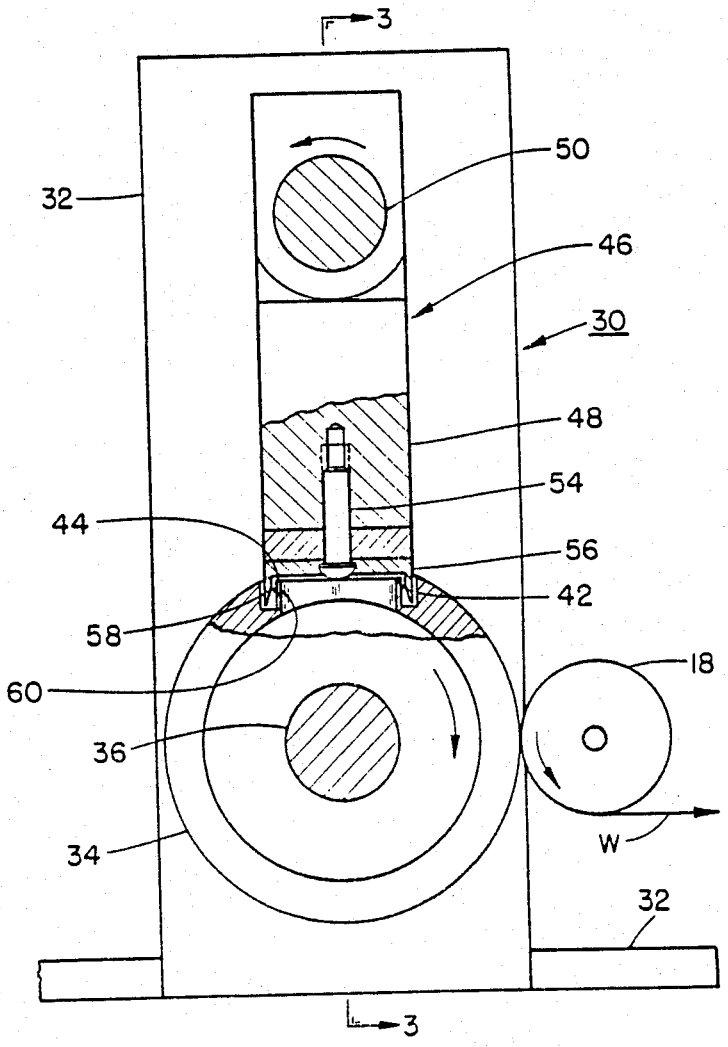
FIG. 2 illustrates, partly in section, a side elevational view of an apparatus for punching holes in a continuously advancing web of a thermoplastic film material.
Figure 3:
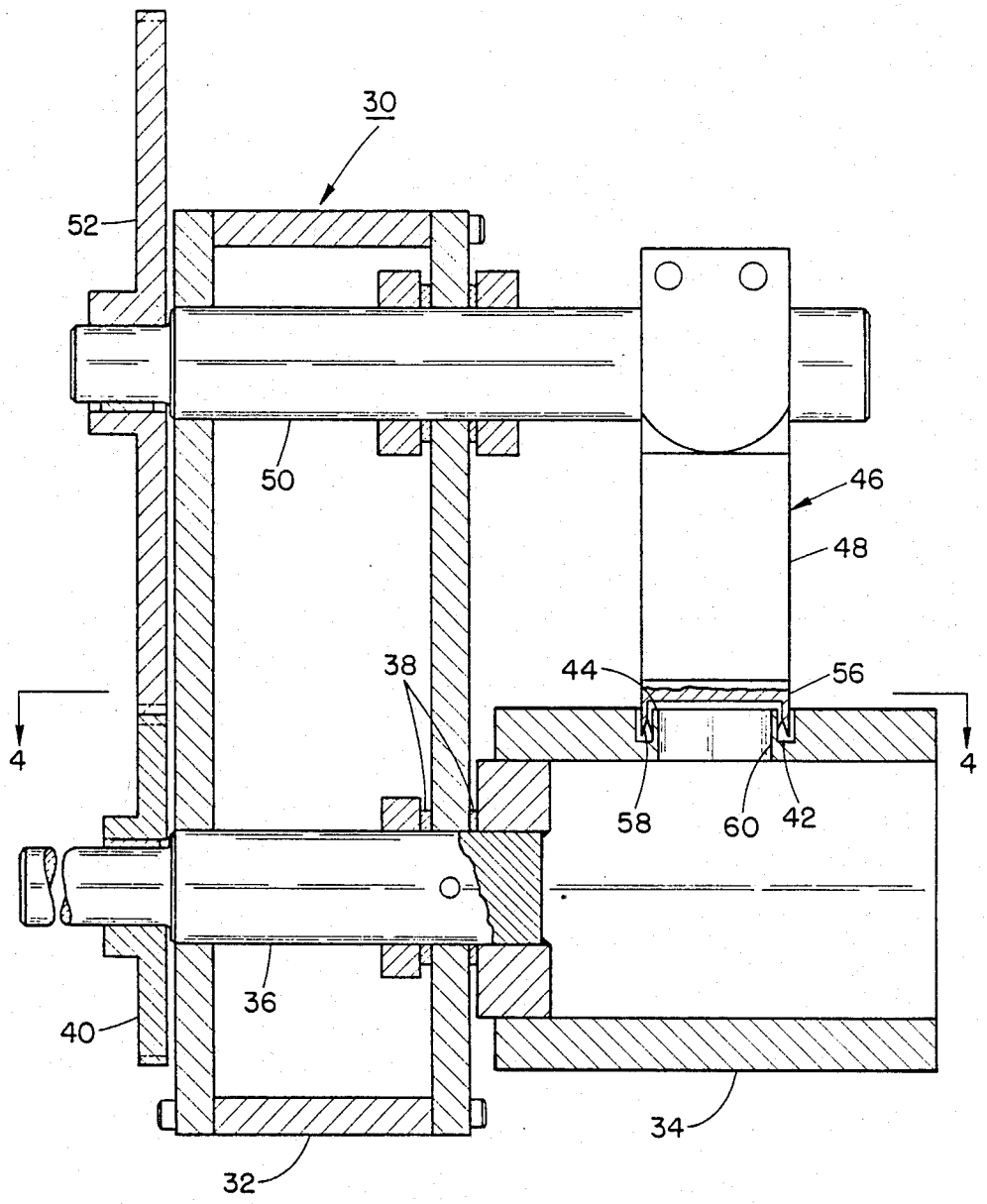
FIG. 3 illustrates a sectional view of the apparatus taken along line 3—3 in FIG. 2.
Figure 4:
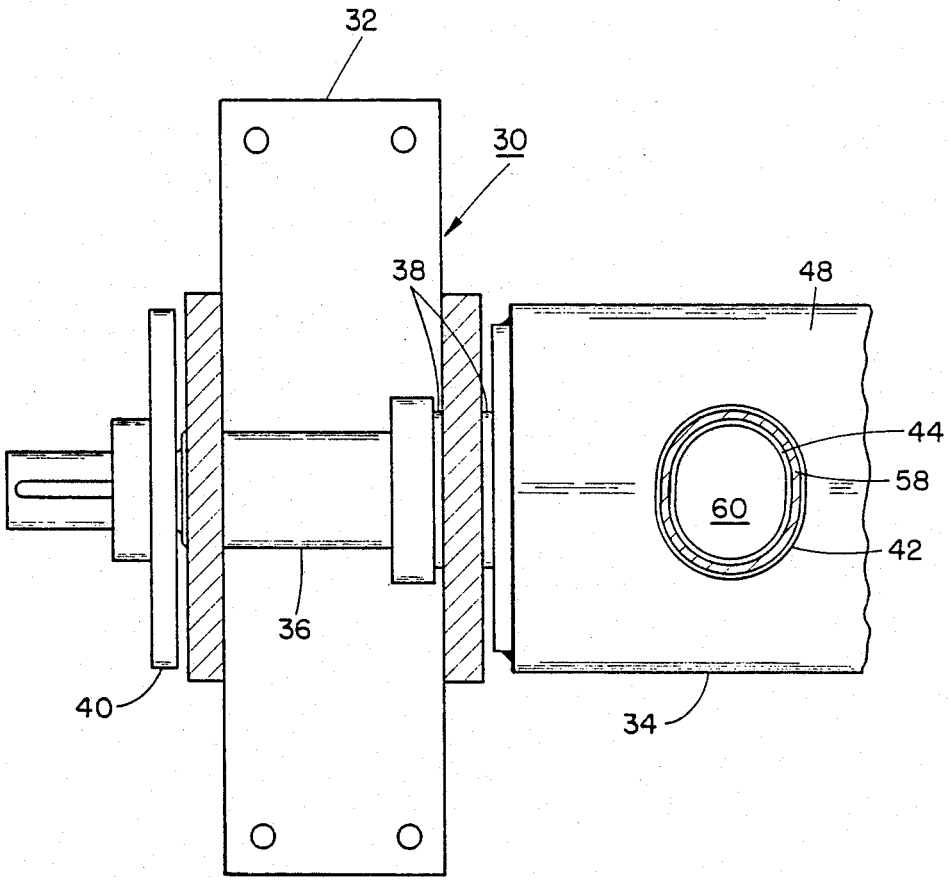
FIG. 4 illustrates a sectional view taken along line 4—4 in FIG. 3.

Referring to the particular embodiment of a rotary die punching arrangement 30 disclosed in FIGS. 2 through 4 of the drawings, rotatably supported from a stationary frame structure 32 is a hollow anvil roll 34, which may be a closed-ended drum constituted of a suitable metal, such as steel or the like. Projecting coaxially from one end of the anvil roll 34 is a shaft 36 which is fixed thereto, which is rotatably journaled in suitable bearings 38 provided in the stationary frame structure 32, and which shaft mounts a spur gear 40 at its free end 42. The circumferential surface of the anvil roll 34 is provided with at least one through opening of a size smaller than that of a die punch cutter. An annular groove or recess 42 is cut into th surface of the anvil roll 12 about the opening, so as to leave an annular land for supporting the film web between the opening and cutting edge of the die punch cutter.

A rotary punching device 46 consists of an arm member 48 which, at one end thereof, is fixedly clamped to a rotatable shaft 50 which is journaled in the frame structure 32, and which extends in parallel spaced relationship with the shaft 36. A spur gear 52 fastened to the other end of the shaft 50 is in driving interengagement with the spur gear 40 such that both shafts 36, 50 may be counter-rotated in predetermined synchronism by a suitable driving arrangement (not shown).

Fastened to the opposite free end of the arm member 48 of the punching device 46, such as by a screw fastening 54, is an annular, or sleeve-like cutter 56 having a serrated or toothed cutting edge 58 facing towards the circumferential surface of the anvil roll 34.

The relative rotational movement between the arm member 48 and that of the anvil roll 34 is correlated and synchronized, for example, by the ratio of the pitch diameters of the interengaged gears 40, 52; the radius of rotation of the cutter 56 about its shaft 50, and the diameter of the anvil roll 34. This then will ensure that the cutting edge 58 will enter the annular groove or recess 42 about the opening 60 formed in the circumferential surface of the anvil roll 34 in an aligned, accurate manner at predetermined intervals of rotation of the anvil drum, with the land 44 providing an internal backup for the film web during the punching operation.

Thus, for example, in producing bags from the plastic film web W, which bags have a repeat length of 30 inches, the anvil roll 34 has a circumferential length of 15 inches. The cutting edge 58 of the cutter 56 has a radius of rotation of about 5 inches about its shaft 52, such that the rotary punching device 46 makes one revolution for every two revolutions of the anvil roll 34.

The holes need not be necessarily round, but may be oval, polygonal or elliptical as shown in FIG. 4 of the drawings, and the arrangement is also adapted to punch accurately-sized holes in the film web W possessing different configurations.

Figure 5:
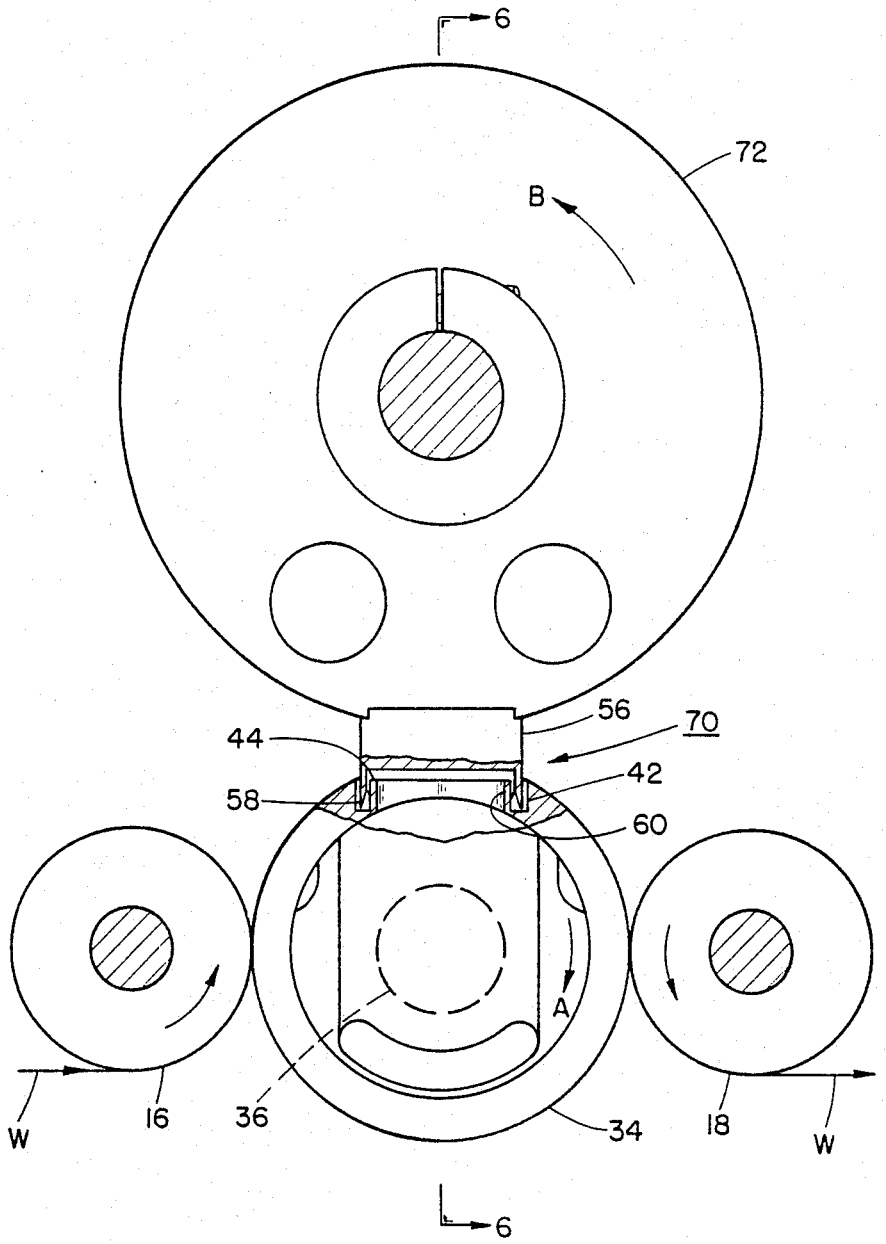
FIG. 5 illustrates, generally schematically, an elevational view of a modified embodiment of the apparatus.
Figure 6:
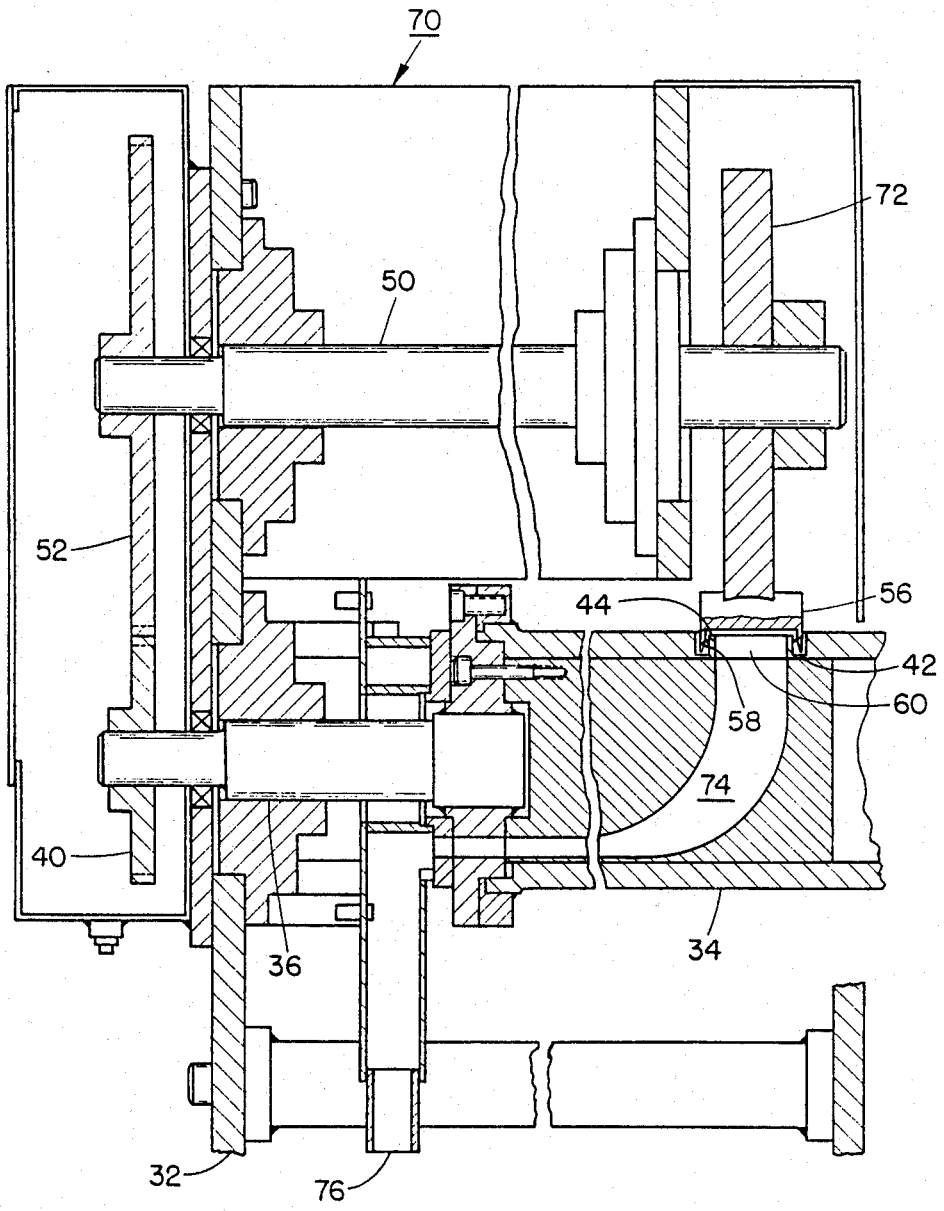
FIG. 6 illustrates, on a reduced scale, a sectional view taken along line 6—6 in FIG. 5.

In the modified embodiment of the rotary die punching arrangement 70 of the invention pursuant to FIGS. 5 and 6, in which components which are similar to or identical with those in the embodiment of FIGS. 2 to 4 are designated by the same reference numerals, the cutter 56 and its serrated cutting edge 58 are mounted on a rotatable disc member 72 which is fastened to the rotatable shaft 52, in lieu of being mounted on an arm member 48.

In this embodiment, the interior of the anvil roll 34 incorporates a passageway 74 which is in communication with the opening 60 and a suctioning device (not shown) for aspirating the punched-out portions of the film web W into the passageway 74, and then discharging them through an outlet 76 for further processing or to a waste disposal.

In the construction of a die punching arrangement 100 pursuant to the generally diagrammatic representation in FIGS. 7 to 10 of the drawings, the arrangement incorporates a novel and unique tumbling or pivotable tubular punching device 102 which will ensure that all of teeth forming the cutting edge of the punching device will pierce the film web W practically simultaneously at substantially right angles or normal orientation relative to the film web surface, thereby increasing the degree of accuracy in the size and shape of the hole punched into the film web.

Figure 7:
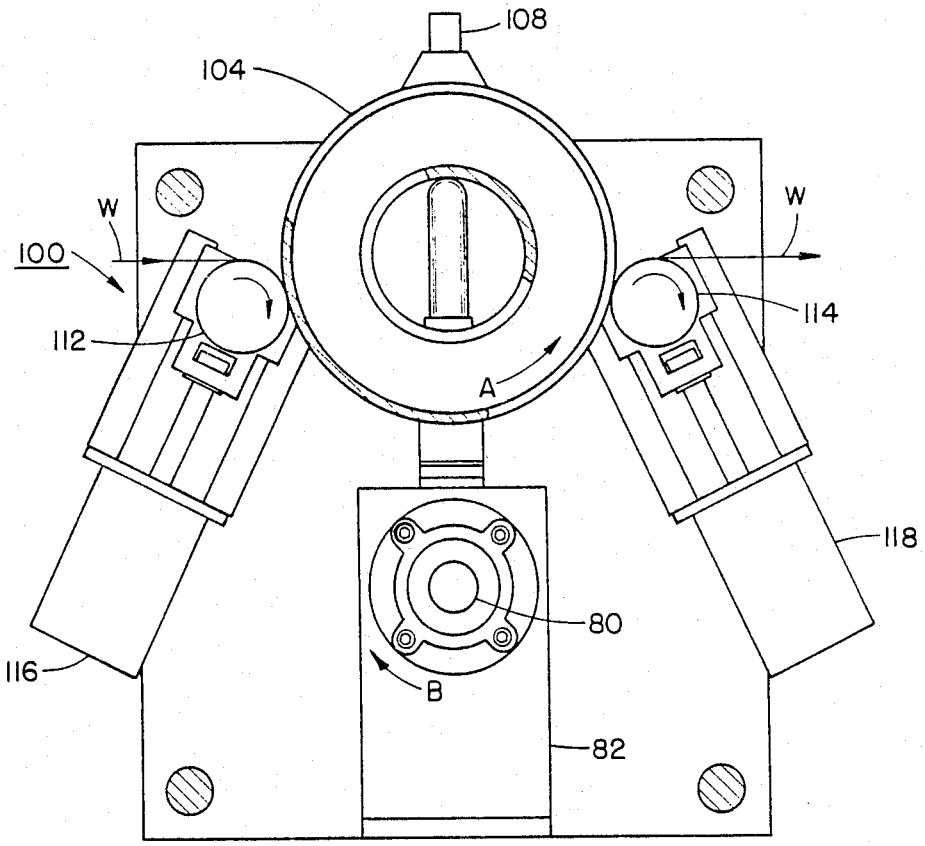
FIG. 7 illustrates, generally diagrammically, a front elevational view of another embodiment of the apparatus incorporating a tumbling punch structure.
Figure 8:
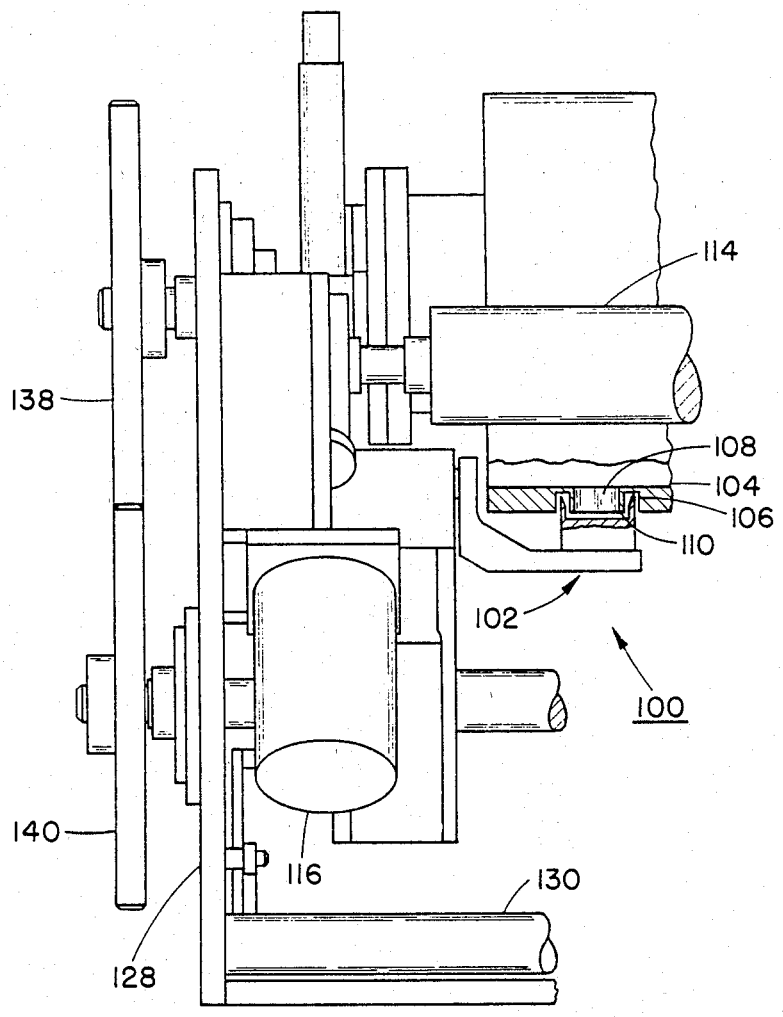
FIG. 8 illustrates a side elevational view of the apparatus of FIG. 7.
Figure 10:
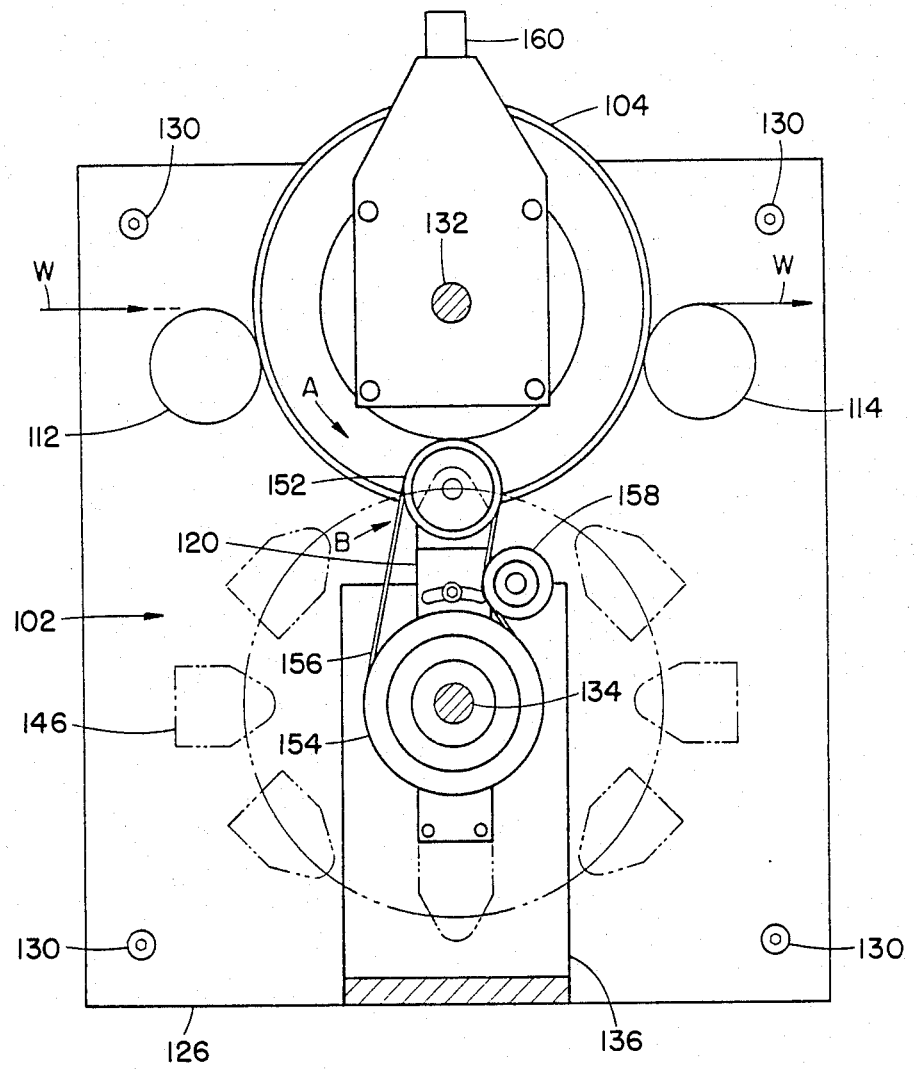
FIG. 10 is a sectional view taken along lines 10—10 in FIG. 9.

As may be readily ascertained from the drawings, an anvil roll 104 which, in this embodiment, is a hollow closed-ended drum and which has a punch-receiving groove or recess 106 provided in its circumferential surface surrounding an opening 108 so as to form an annular land 110 therebetween, has a pair of freely-rotatable tension rollers 112 and 114 arranged, respectively, upstream and downstream thereof. Suitable biasing devices 116 and 118, which may be either spring-loaded pusher members, pneumatic or hydraulically-operated pistons or the like, will cause the tension rollers 112 and 114 to each be biased into surface contact with the circumference of the anvil roll 104, as is clearly illustrated in FIGS. 7 and 8 of the drawings. This surface contact between the rotatable tension rollers 112 and 114, and the anvil roll 104, will cause the thermoplastic film web W which is being conveyed along the direction of the arrow, as shown in FIG. 7, to be maintained under tension as the web is conducted over the circumferential surface of the anvil roll 104 rotating in the direction of arrow A, so as to maintain the film web thereon in a predetermined surface-contacting tensioned condition. The anvil roll 104 is driven through a suitable drive arrangement, described in further detail hereinbelow, in the direction of arrow A while, concurrently therewith, a rotatable arm 120, which forms a part of the punching device 102, is rotated in the direction of arrow B as shown in FIGS. 7 and 10. The rotatable arm 120 support the tubular punch unit 122 in a manner and orientation relative to the annular groove opening 108 in anvil roll 104, as is described in further detail hereinbelow.

The entire arrangement is supported through the intermediary of a stationary frame structure 124, similar to frame structure 32 of FIG. 1, and comprises suitable upstanding support plates 126, 128 which are interconnected by transverse rods and/or support beams 130.

Figure 9:
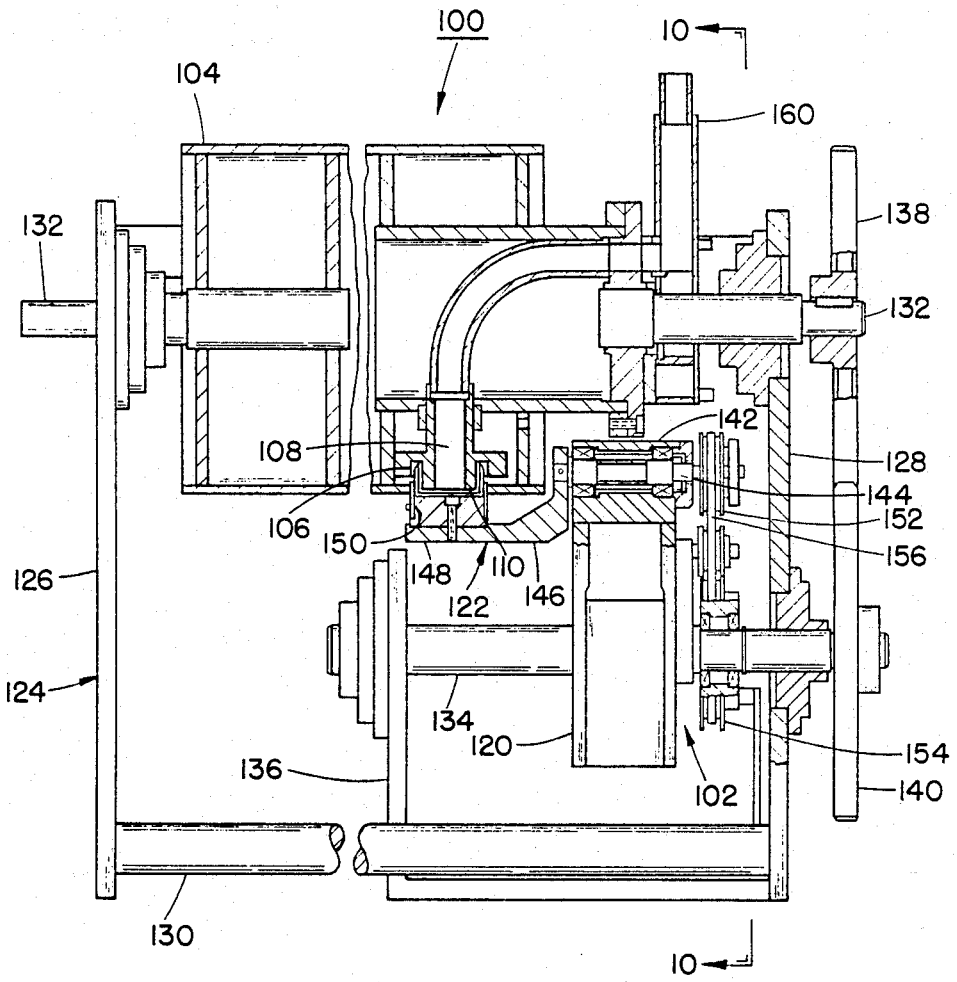
FIG. 9 illustrates a transverse sectional view through the apparatus of FIG. 7, showing internal details thereof.

Rotatably journaled in suitable support bearings in the plates 126 and 128, is a shaft 132, consisting of axially spaced shaft sections having the anvil roll 104 fastened coaxially therebetween to form an integral or unitary structure therewith. Similarly, the arm 120 of the rotary punching device 102 is rotatably journaled on a shaft 134 which is rotatably supported by suitable bearing in the plate 128 and another upright plate 136 of the frame structure 124 intermediate plates 126 and 128, and which shaft 134 is in parallel spaced relationship with the shaft 132. As illustrated in FIG. 9 of the drawings, a gear 138 fastened to one end of shaft 132 is in operative interengagement with a gear 140 fastened to the end of the shaft 134 in the same plane therewith, so as to enable the anvil roll 104 and the arm 120 to be rotated, respectively, in the directions of arrows A and B at predetermined rotational speeds by a suitable drive (not shown).

A radial extension 142 is provided at one location along the extent of the arm 120, within which there is rotatably supported, on suitable bearings, a shaft 144 extending through the extension 142 of arm 120 in parallel spaced relationship with the shafts 132 and 134, and with the opposite ends of the shaft 144 projecting from both side wall surfaces of the arm 120.

The tubular punch unit 122 is supported at one end of the shaft 144, so as to be in radial alignment with the annular groove 106 extending about opening 108 in anvil roll 104, and is constituted of an angle bracket 146 having a first flange portion fastened to the end of shaft 144, and a second flange portion 148 extending perpendicularly away from the drum 122. Fastened to a surface of the flange portion 148, such as by a screw fastener, is a cup-shaped punching cutter 150 having a serrated or toothed cutting edge which is adapted to radially enter the annular groove 106 in the circumference of the anvil roll 104.

The opposite end of the shaft 144 projecting from the other side of the arm 120 has a belt pulley 152 fastened thereon, and which is in operative driving engagement with a pulley 154 fastened in alignment therewith on the shaft 134 through the intermediary of a belt 156 entrained over the pulleys. The belt 156 is maintained tensioned by a further pulley 158 fastened to the arm 120 intermediate the pulleys 152, 154.

Within the hollow anvil roll 104, and communicating with the opening 108, there may be arranged a conduit 160 which connects to a suitable suctioning device (not shown) for aspirating away the punched out film discs, chips or segments produced during the film punching operation.

From the foregoing, it clearly appears that the invention is directed to an extremely simple rotary die punching arrangement for accurately punching holes through a continuously advancing film of a thermoplastic web material, wherein the holes in the web may be spaced as required depending upon the proportional diameters and speeds of rotation of the anvil roll and the rotary die punch, while concurrently permitting the punching of holes of configurations which are other than round into the web.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A rotary die punching arrangement for punching holes into a continuously advancing thermoplastic film web, comprising:

(a) a rotatable anvil roll having said film web extending in surface contact with at least a portion of the circumference of said roll; at least one opening of predetermined size being formed in the circumferential surface of said anvil roll; a groove in the circumferential surface of said anvil roll surrounding said opening and forming an annular land between said groove and said opening.

(b) a rotary punch having a serrated cutting edge at the radially outer end thereof for piercing said web and being dimensioned to enter said groove in the surface of said anvil roll at predetermined intervals;

(c) means for rotating said rotary punch; and means for imparting rotation to said anvil roll;

(d) and means for synchronizing the rotational movements of said anvil roll and said rotary punch said film web advancing over said opening on the anvil roll facing said punch whereby said serrated cutting edge punches a hole into said web upon entering said groove in said anvil roll, with said film web being supported on said land and the surface of the anvil roll about the groove.

2. An arrangement as claimed in claim 1, wherein said opening in said anvil roll is smaller than the diameter of said punch, and said groove is sized in conformance with said cutting edge.

3. An arrangement as claimed in claim 1, comprising a stationary frame structure, said means for rotating said rotary punch being a first shaft rotatably journaled on said frame structure; said means for rotating said anvil roll being a second shaft rotatably journaled on said frame structure; and said means for synchronizing the rotational movements of said rotary punch and said anvil roll including means operatively interconnecting said first and second shafts.

4. An arrangement as claimed in claim 3, wherein said means operatively interconnecting said first and second shaft comprises interengaged driving gears fastened to the ends of said shafts for rotating said shafts at predetermined counter-rotating speed ratios.

5. An arrangement as claimed in claim 1, wherein said anvil roll comprises a hollow cylindrical drum, said opening extending through the wall of said anvil roll.

6. An arrangement as claimed in claim 5, comprising suctioning means communicating with the interior of said hollow anvil roll and said opening for aspirating the segments of said film web punched out by said rotary punch.

7. An arrangement as claimed in claim 1, comprising means for tensioning said film web during the advance of said web along the circumferential surface of said anvil roll.

8. An arrangement as claimed in claim 7, wherein said film web tensioning means comprise first and second freely-rotatable tensioning rollers, one said tensioning roller being positioned upstream of said anvil roll and the other said tensioning roller being positioned at the downstream side of said anvil roll, said film web being entrained over said tensioning rollers during advance thereof.

9. An arrangement as claimed in claim 8, wherein the circumferences of said tensioning rollers are in surface-contact with said anvil roll.

10. An arrangement as claimed in claim 1, comprising a rotatable arm; means mounting said rotary punch on one side of said arm for controllably pivoting said punch relative to said arm about an axis extending in parallel spaced relationship with the axis of rotation of said arm, said rotary punch having a tubular serrated cutting edge adapted to pierce said film web and enter said groove in said anvil roll at substantially right angles to the surface of said film web responsive to the pivoting of said punch; and means for rotating said rotatable arm and concurrently pivoting said rotary punch; and means for synchronizing the rotational movements of said anvil roll and said rotatable arm and the pivoting of said rotary punch as said film web advances over said opening on the anvil roll facing said punch whereby said serrated cutting edge punches a hole into said web upon radially entering said groove in said anvil roll.

11. An arrangement as claimed in claim 1, comprising a stationary frame structure, said means for rotating said rotatable arm being a first shaft rotatably journaled on said frame structure; said means for rotating said anvil roll being a second shaft rotatably journaled on said frame structure; and said means for synchronizing the rotational movements of said rotatable arm and said anvil roll including means operatively interconnecting said first and second shafts.

12. An arrangement as claimed in claim 11, comprising a third shaft rotatably journaled in said rotatable arm in parallel spaced relationship with said first shaft, said third shaft being arranged proximate one end of and arm and extending from the opposite sides of said arm; a stationary first pulley being secured against rotation on said first shaft adjacent one of said arm sides, a second pulley being fixedly mounted on the end of said third shaft on said arm side; drive belt means engaging said pulleys for rotating said third shaft in response to the rotation of said arm about said first shaft; and means supporting said rotary punch being mounted on the end of said third shaft on the opposite side of said arm for orienting the serrated cutting edge of said punch in perpendicular alignment with the groove in said anvil roll during approach of said punch and upon the piercing of said film web and retracting of said punch therefrom.

13. An arrangement as claimed in claim 12, wherein said means mounting said rotary punch comprises an angle bracket having first flange portion fastened to said third shaft, and a second flange portion supporting said rotary punch.

14. A method for punching holes into a continuously advancing thermoplastic film web, comprising:

(a) advancing said film web over a rotatable anvil roll with said film web extending in surface contact with at least a portion of the circumference of said roll; at least one opening of predetermined size being formed in the circumferential surface of said anvil roll, and a groove in the circumferential surface of said anvil roll surrounding said hole and forming an annular land between said groove and said opening;

(b) causing a rotary punch having a serrated cutting edge at the radially outer end thereof to pierce said film web and to enter said groove in said anvil roll at predetermined intervals;

(c) rotating said rotary punch; and concurrently rotating said anvil roll;

(d) and synchronizing the rotational movements of said anvil roll and said rotary punch with said film web advancing over said opening on the anvil roll facing said punch whereby said serrated cutting edge punches a hole into said web upon entering said groove in said anvil roll, while said film web is supported on said land and the surface of the anvil roll about the groove.

15. A method as claimed in claim 14, wherein said opening in said anvil roll is smaller than the diameter of said punch.

16. A method as claimed in claim 14, comprising rotating said rotary punch with a first shaft rotatably journaled on a stationary frame structure; rotating said anvil roll with a second shaft rotatably journaled on said frame structure; and synchronizing the rotational movements of said rotary punch and said anvil roll by operatively interconnecting said first and second shafts.

17. A method as claimed in claim 16, comprising operatively interconnecting said first and second shafts by interengaged driving gears fastened to the ends of said shafts for rotating said shafts at predetermined counter-rotating speed ratios.

18. A method as claimed in claim 14, wherein said anvil roll is a hollow drum, comprising suctioning the interior of said hollow anvil roll for aspirating the segments of said film web punched out by said rotary punch.

19. A method as claimed in claim 14, comprising tensioning said film web during the advance of said web along the circumferential surface of said anvil roll.

20. A method as claimed in claim 19, comprising tensioning said film web over first and second freely-rotatable tensioning rollers, one said tensioning roller being positioned upstream of said anvil roll and the other said tensioning roller being positioned at the downstream side of said anvil roll, and entraining said film web over said tensioning rollers during advance thereof.

21. A method as claimed in claim 20, comprising positioning said tensioning rollers in surface-contact with said anvil roll.

22. A method as claimed in claim 14, comprising rotating a rotatable arm mounting said rotary punch while concurrently pivoting said rotary punch to effect the radial orientation of said punch while piercing the film web; and rotating said anvil roll in conjunction with the rotation; and synchronizing the rotational movements of said anvil roll and said arm and the pivoting of said rotary punch with said film web advancing over said opening and groove on the anvil roll facing said punch whereby said serrated cutting edge punches a hole into said web while radially entering said groove in said anvil roll.

23. A method as claimed in claim 22, comprising rotating said rotatable arm on a first shaft rotatably journaled on a stationary frame structure; rotating said anvil roll on a second shaft rotatably journaled on said frame structure; pivoting said rotary punch on a third shaft rotatably journaled in said arm in coaxially spaced relationship with said first shaft; and synchronizing the rotational movements of said rotatable arm and anvil roll and the pivoting motion of said rotary punch by operatively interconnecting said first and second shafts, and said first and third shafts.

24. A method as claimed in claim 23, comprising operatively interconnecting said first and second shafts by interengaged driving gears fastened to the ends of said shafts for rotating said shafts at predetermined counter-rotating speed ratios.

25. A method as claimed in claim 24, comprising operatively interconnecting said first and third shafts by a belt drive engaging pulleys fastened on said shafts.

26. A method as claimed in claim 25, comprising mounting said rotary punch on an angle bracket fastened to an end of said third shaft which is opposite the end to which one of said pulleys is fastened.

* * * * *